US008074689B2

(12) United States Patent
Tseng

(10) Patent No.: US 8,074,689 B2
(45) Date of Patent: Dec. 13, 2011

(54) METHOD FOR MAKING AN ARTIFICIAL RATTAN WEB

(75) Inventor: Kenneth Tseng, Chiayi Hsien (TW)

(73) Assignee: Canbelin Industrial Co., Ltd., Chiayi (TW)

( * ) Notice: Subject to any disclaimer, the term of this patent is extended or adjusted under 35 U.S.C. 154(b) by 1048 days.

(21) Appl. No.: 11/947,698

(22) Filed: Nov. 29, 2007

(65) Prior Publication Data

US 2009/0044879 A1 Feb. 19, 2009

(30) Foreign Application Priority Data

Aug. 16, 2007 (TW) ..... 96130315 A

(51) Int. Cl.
*B27J 7/00* (2006.01)

(52) U.S. Cl. ..... 144/333
(58) Field of Classification Search ..... 144/333
See application file for complete search history.

(56) References Cited

U.S. PATENT DOCUMENTS 3,062,244 A * 11/1962 Fong ..... 139/424
* cited by examiner

*Primary Examiner* — Lynda Salvatore
(74) *Attorney, Agent, or Firm* — Ladas & Parry, LLP

(57) ABSTRACT

A method for making an artificial rattan web, includes: (a) providing a guiding body having a curved surface, and a threading block that is disposed downstream of the guiding body and that is formed with a rattan hole and a thread hole; (b) passing an artificial rattan strip and a thread through the guiding body, and respectively through the rattan hole and the thread hole in the threading block; (c) weaving the artificial rattan strip and the thread; and (d) fusing together the artificial rattan strip and the thread at intersections thereof.

7 Claims, 4 Drawing Sheets

METHOD FOR MAKING AN ARTIFICIAL RATTAN WEB

CROSS-REFERENCE TO RELATED APPLICATION

This application claims priority of Taiwanese application no. 096130315, filed on Aug. 16, 2007.

BACKGROUND OF THE INVENTION

1. Field of the Invention

This invention relates to a method for making an artificial rattan web, more particularly to a method using a guiding body for preventing an artificial rattan strip from twisting during weaving.

2. Description of the Related Art

A conventional method for making an artificial rattan web normally involves using guiding and positioning means, such as a block formed with a guiding hole, to guide and direct a moving artificial rattan strip to weaving means for weaving. However, the conventional guiding and positioning means is unable to prevent the artificial rattan strip from twisting.

SUMMARY OF THE INVENTION

Therefore, the object of the present invention is to provide a method for making an artificial rattan web that can overcome the aforesaid drawback associated with the prior art.

Another object of this invention is to provide an artificial rattan web made by the method.

According to one aspect of the present invention, a method for making an artificial rattan web, comprises: (a) providing a guiding body having a curved surface, and a threading block that is disposed downstream of the guiding body and that is formed with a rattan hole and a thread hole; (b) passing an artificial rattan strip and a thread through the guiding body such that each of the artificial rattan strip and the thread abuts against the curved surface of the guiding body, and respectively through the rattan hole and the thread hole in the threading block so as to prevent twist of the artificial rattan strip and the thread; (c) weaving the artificial rattan strip and the thread so as to form an artificial rattan web; and (d) fusing together the artificial rattan strip and the thread at intersections thereof.

According to another aspect of this invention, an artificial rattan web comprises: a plurality of parallel artificial rattan strips extending in a weft direction; a plurality of parallel first threads extending in a warp direction and interlacing with the artificial rattan strips; and a plurality of parallel second threads extending in the weft direction and disposed alternately with the artificial rattan strips. The second threads interlace with the first threads.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
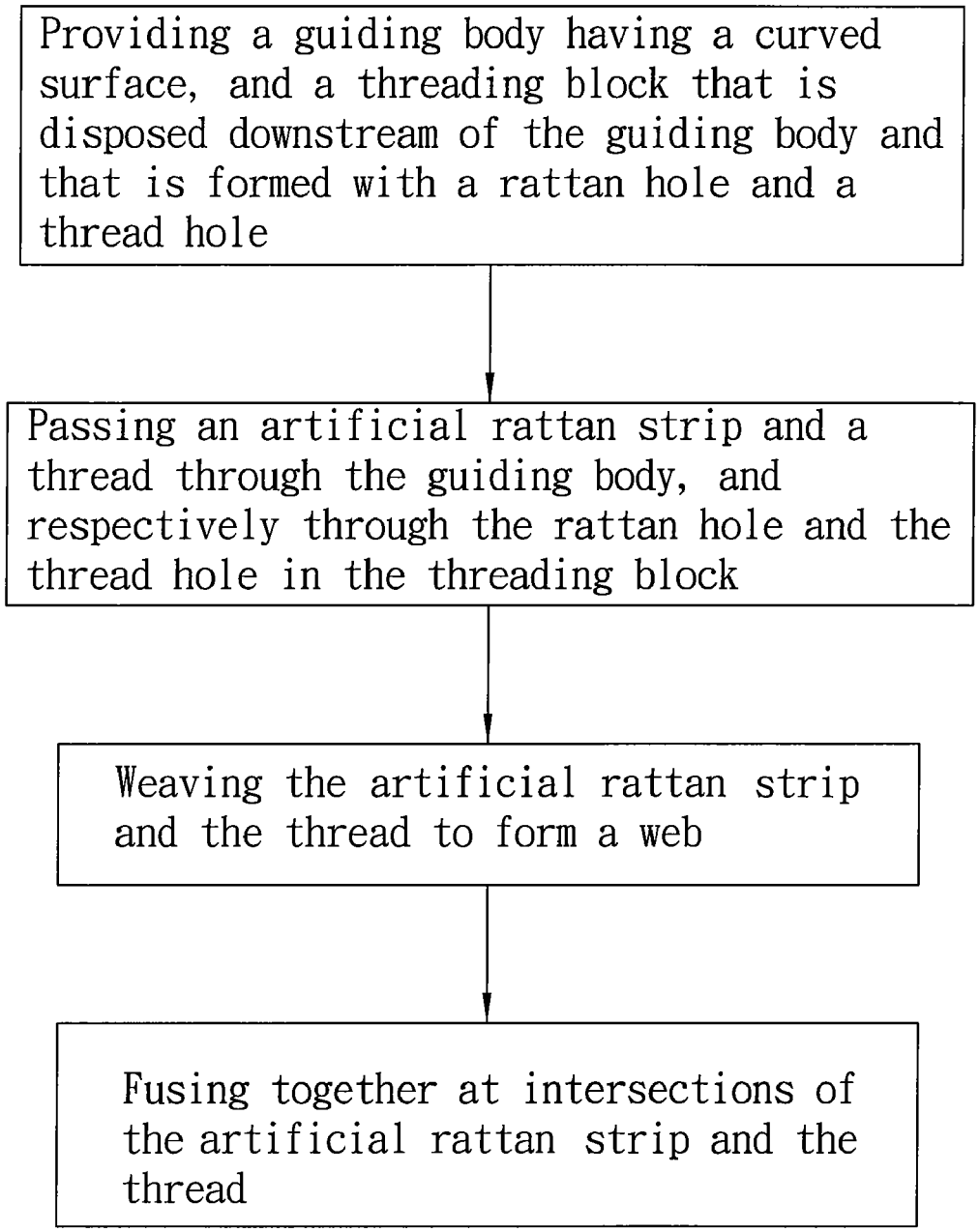
FIG. 1 is a flowchart to illustrate consecutive steps of the preferred embodiment of a method for making an artificial rattan web according to this invention.
Figure 2:
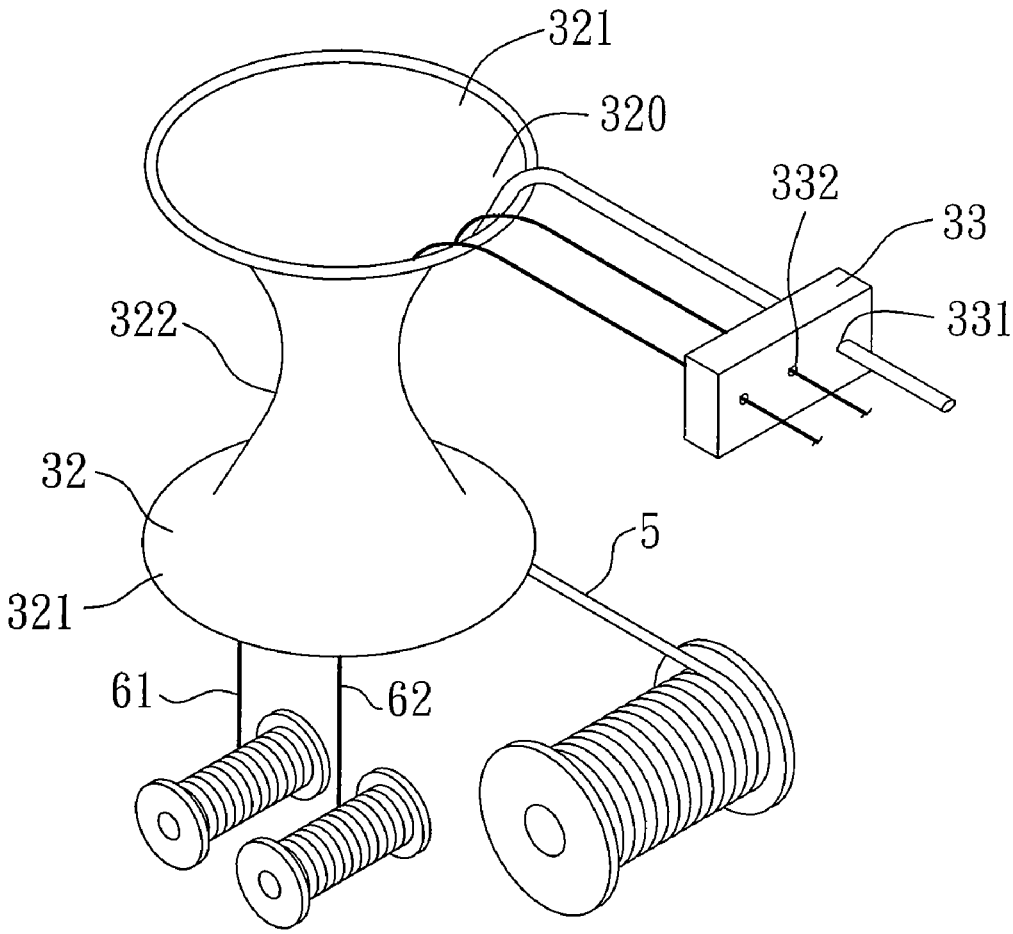
FIG. 2 is a perspective view to illustrate how an artificial rattan strip and a thread pass through a chamber of a guiding body used in the preferred embodiment.

FIGS. 1 and 2 illustrate the preferred embodiment of a method for making an artificial rattan web according to this invention.

The method includes: (a) providing a guiding body 32 having a curved surface 320, and a threading block 33 that is disposed downstream of the guiding body 32 and that is formed with a rattan hole 331 and a pair of thread holes 332; (b) passing an artificial rattan strip 5 and a pair of threads 61, 62 through the guiding body 32 such that each of the artificial rattan strip 5 and the threads 61, 62 abuts against the curved surface 320 of the guiding body 32, and respectively through the rattan hole 331 and the pair of thread holes 332 in the threading block 33 so as to prevent twist of the artificial rattan strip 5 and the thread 61, 62; (c) weaving the artificial rattan strip 5 and the threads 61, 62 so as to form an artificial rattan web 1 (see FIG. 3); and (d) fusing together the artificial rattan strip 5 and the threads 61, 62 at intersections thereof.

Preferably, the rattan hole 331 in the threading block 33 has a shape corresponding to that of a cross-section of the artificial rattan strip 5.

In this embodiment, the guiding body 32 is hollow, has a middle tube portion 322 and two end bell portions 321 extending and enlarged in cross section from two opposite ends of the middle tube portion 322, and defines a chamber therein. The middle tube portion 322 and the two end bell portions 321 cooperatively define the curved surface 320 of the guiding body 32. The curved surface 320 defines the chamber and is saddle-shaped. The artificial rattan strip 5 and the thread 61, 62 enter into and pass through the chamber of the guiding body 32.

Preferably, the threading block 33 and the guiding body 32 are arranged in such a manner that the artificial rattan strip 5 forms a U-shaped turn (see FIG. 2) around the curved surface 320 of the guiding body 32 so as to enhance a contact area therebetween, thereby ensuring the prevention of the artificial rattan strip 5 from twisting.

Figure 3:
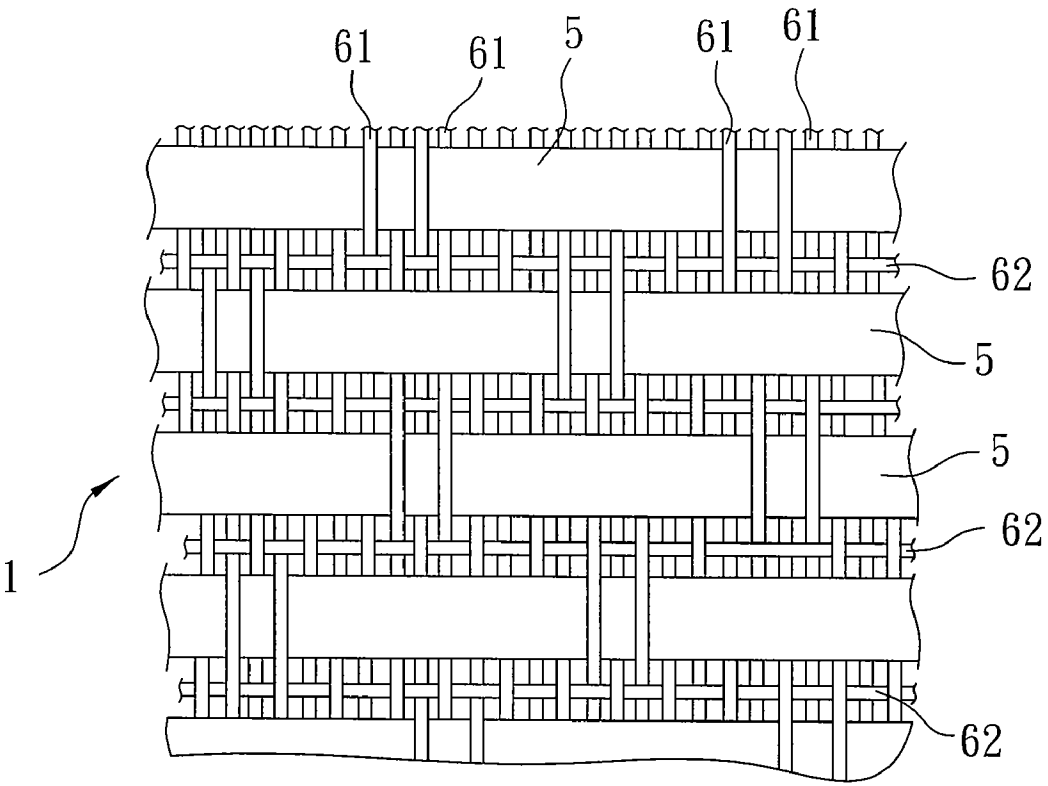
FIG. 3 is a fragmentary top view of the preferred embodiment of an artificial rattan web according to this invention.

FIG. 3 illustrates the preferred embodiment of an artificial rattan web 1 made by the method of this invention. The artificial rattan web 1 includes: a plurality of parallel artificial rattan strips 5 extending in a weft direction; a plurality of parallel first threads 61 extending in a warp direction and interlacing with the artificial rattan strips 5; and a plurality of parallel second threads 62 extending in the weft direction and disposed alternately with the artificial rattan strips 5. The second threads 62 interlace with the first threads 61.

Preferably, the artificial rattan strips 5 and the first and second threads 61, 62 are fused together at intersections thereof.

In this embodiment, each of the first and second threads 61, 62 is a yarn.

Figure 4:
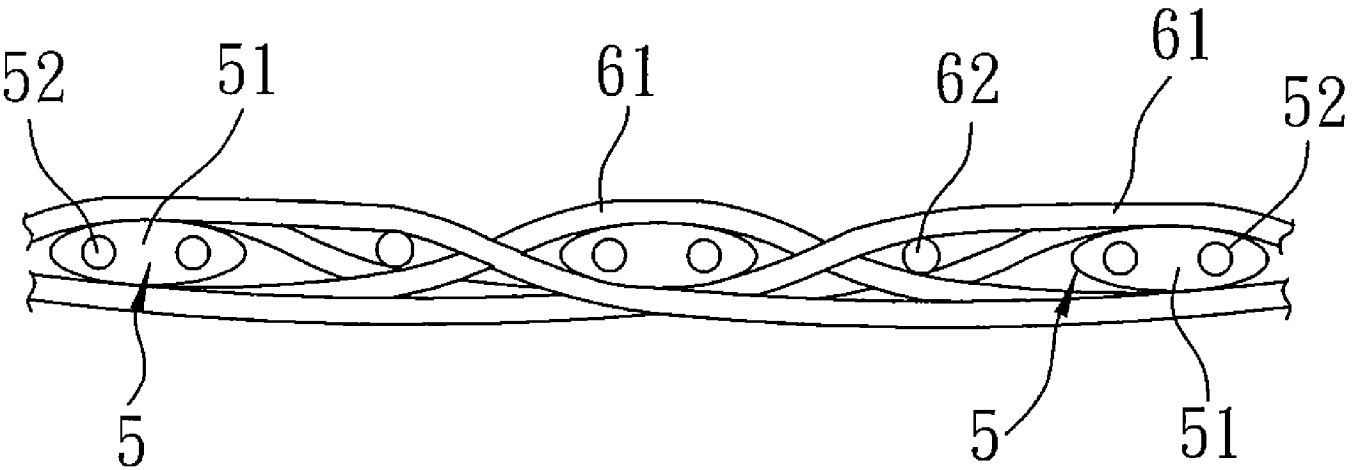
FIG. 4 is a fragmentary side view of the preferred embodiment of FIG. 3.

Preferably, each of the artificial rattan strips 5 has a pair of parallel inner yarns 52 and a plastic material 51 molded over and enclosing the inner yarns 52 (see FIG. 4).

By using the guiding body 32 having the curved surface 320 to contact the artificial rattan strip 5, and to confine and guide the artificial rattan strip 5 and the threads 61, 62 during weaving, the aforesaid drawback associated with the prior art can be eliminated.

With the invention thus explained, it is apparent that various modifications and variations can be made without departing from the spirit of the present invention. It is therefore intended that the invention be limited only as recited in the appended claims.

What is claimed is:

1. A method for making an artificial rattan web, comprising:

providing a guiding body having a curved surface, and a threading block that is disposed downstream of the guiding body and that is formed with a rattan hole and a thread hole;

passing an artificial rattan strip and a thread through the guiding body such that each of the artificial rattan strip and the thread abuts against the curved surface of the guiding body, and respectively through the rattan hole and the thread hole in the threading block so as to prevent twist of the artificial rattan strip and the thread;

weaving the artificial rattan strip and the thread so as to form an artificial rattan web; and fusing together the artificial rattan strip and the thread at intersections thereof.

2. The method of claim 1, wherein the rattan hole in the threading block has a shape corresponding to that of a cross-section of the artificial rattan strip.

3. The method of claim 1, wherein the guiding body is hollow, has a middle tube portion and two end bell portions extending and enlarged in cross section from two opposite ends of the middle tube portion, and defines a chamber therein, the middle tube portion and the two end bell portions cooperatively defining the curved surface of the guiding body, the curved surface being saddle-shaped, the artificial rattan strip and the thread entering into and passing through the chamber of the guiding body.

4. The method of claim 3, wherein the threading block and the guiding body are arranged in such a manner that the artificial rattan strip forms a U-shaped turn around the curved surface of the guiding body.

5. An artificial rattan web comprising:

a plurality of parallel artificial rattan strips extending in a weft direction;

a plurality of parallel first threads extending in a warp direction and interlacing with said artificial rattan strips; and a plurality of parallel second threads extending in the weft direction and disposed alternately with said artificial rattan strips, said second threads interlacing with said first threads.

6. The artificial rattan web of claim 5, wherein said artificial rattan strip and said first and second threads are fused together at intersections thereof.

7. The artificial rattan web of claim 5, wherein each of said artificial rattan strips comprises a yarn and a plastic material molded over and enclosing said yarn.

* * * * *